US006546724B2

(12) United States Patent
Nishimura et al.

(10) Patent No.: US 6,546,724 B2
(45) Date of Patent: Apr. 15, 2003

(54) WORK MACHINE INCLUDING FINELY ADJUSTABLE OPERATION MODES

(75) Inventors: Satoru Nishimura, Osaka (JP); Takumi Nagahara, Osaka (JP); Takanori Hata, Osaka (JP)

(73) Assignee: Komatsu Limited, Tokyo (JP)

( * ) Notice: Subject to any disclaimer, the term of this patent is extended or adjusted under 35 U.S.C. 154(b) by 0 days.

(21) Appl. No.: 09/910,056

(22) Filed: Jul. 20, 2001

(65) Prior Publication Data

US 2002/0017189 A1 Feb. 14, 2002

(30) Foreign Application Priority Data

Aug. 3, 2000 (JP) ..... 2000-236064

(51) Int. Cl.[7] ..... F16D 31/02
(52) U.S. Cl. ..... 60/431
(58) Field of Search ..... 60/431, 432

(56) References Cited

U.S. PATENT DOCUMENTS

| | | | | |
|---|---|---|---|---|
| 4,697,418 A | * | 10/1987 | Okabe et al. | 60/431 |
| 4,727,490 A | * | 2/1988 | Narita et al. | 60/431 X |
| 4,942,737 A | * | 7/1990 | Tatsumi | 60/431 |
| 5,077,973 A | | 1/1992 | Suzuki et al. | 60/428 |
| 5,295,353 A | * | 3/1994 | Ikari | 60/431 X |
| 5,622,050 A | * | 4/1997 | Ishino et al. | 60/431 X |
| 5,630,317 A | | 5/1997 | Takamura et al. | 60/445 |
| 5,970,709 A | | 10/1999 | Tohji | |
| 6,006,521 A | | 12/1999 | Fuchita et al. | |
| 6,183,210 B1 | * | 2/2001 | Nakamura | 60/431 X |

FOREIGN PATENT DOCUMENTS

| | | |
|---|---|---|
| EP | 0 646 724 A1 | 4/1995 |
| EP | 0 791 771 A1 | 8/1997 |
| JP | 6-306892 | 11/1994 |
| WO | WO 98/06936 | 2/1998 |

* cited by examiner

*Primary Examiner*—F. Daniel Lopez
(74) *Attorney, Agent, or Firm*—Bell, Boyd & Lloyd LLC

(57) ABSTRACT

Various work machines in which safety of operation and operation efficiency can be enhanced in accordance with variation in the kind of operation and operation condition when operation is carried out based on a previously set operation mode of an operation machine, and operation speed of the operation machine or running speed of the work machine can finely be adjusted is provided. The work machine comprises mode switching means having a mode switching switch and the like of operation modes of one or more operation machines. A speed finely-adjusting switch is disposed for finely adjusting an operation speed and/or a running speed to values out of range set in each mode by manual operation. An engine, a pump, a flow rate adjusting valve disposed in a driving circuit of one or more operation machine and running motor and the like are operated by a signal output by operating the speed finely-adjusting switch, and the engine revolution number and the pump discharge amount are adjusted. Even under an environment in which operation range is changed or an obstruction may exist, it is possible to effectively obtain optimal operation mode of the operation machine suitable for the kind of operation which is carried out and operation condition and skill of an operator, and stable running performance and operability of the operation machine can be realized.

3 Claims, 5 Drawing Sheets

WORK MACHINE INCLUDING FINELY ADJUSTABLE OPERATION MODES

BACKGROUND OF THE INVENTION

1. Field of the Invention

The present invention relates to a self-propelled work machine such as an earthmoving machine or an industrial tractor including various operation modes, and more particularly, to a work machine capable of expanding operation speed of an operation machine and running speed of the work machine up to a desired speed range not within the above operation modes in accordance with variation in kinds of operation or operation conditions under various operation modes.

2. Description of the Related Art

Conventionally, various work machines for construction or civil engineering are known. This kind of work machine includes a revolving body mounted on a running body such that the revolving body can revolve around a vertical axis, and the revolving body has operation machines such as a main boom, a stick boom, and a bucket. In this work machine, pressure oil delivered from a variable displacement pump driven by an engine is switched by a plurality of direction-switching valves, thereby selectively supplying the pressure oil to actuators of a main boom cylinder, a stick boom cylinder, a bucket cylinder, a revolving motor and a running motor to drive each operation machine or allow the work machine run.

Japanese Patent Publication No.2863599 discloses one example of the work machine having this operation machine. A hydraulic operation machine disclosed in this publication comprises an acceleration lever for setting the number of revolution of an engine, a revolution speed instruction transmitter for detecting an operation amount of acceleration lever to output an engine revolution speed instruction signal in accordance with the operation amount, engine revolution speed setting means for increasing or reducing the engine revolution speed, flow rate adjusting means for increasing or reducing a pump flow rate of a variable displacement pump, a relief valve for setting a discharge-side maximum operation pressure of the pump, and relief pressure setting means for setting a maximum pressure of the pressure oil introduced into the operation machine actuator.

Further, this hydraulic operation machine includes, in addition to a combination of operation power and operation speed of an actuator required during normal operation, operation mode selecting means in which various operation modes such as an operation mode for operating the actuator at high speed, an operation mode for carrying out precise operation are previously stored so that these modes can freely be selected.

If an operator selects a desired operation mode using the operation mode selecting means in accordance with the kind of operation to be carried out or operation condition, the operation mode selecting means selects at least one of a maximum engine revolution number of the engine, a maximum delivery flow rate of the pump, a maximum pressure of pressure oil to be introduced into the actuator for the operation machine which are previously stored for each of the selected operation mode, and the selected value is output to a controller as an operation mode instruction signal.

The controller receives an operation instruction signal from the operation mode selecting means and an engine revolution speed instruction signal from the revolution speed instruction transmitter, lower one of the operation mode instruction signal and the engine revolution speed instruction signal is selected as the maximum engine revolution number, and an instruction signal is output to the engine revolution speed setting means. At the same time, an instruction signal is output to the flow rate adjusting means of the pump based on the operation mode instruction signal, and an instruction signal is output to the relief valve and the relief pressure setting means.

In this manner, the instruction signal is output to the flow rate adjusting means and the engine revolution speed setting means so that the operation speed of the actuator which is to be operated based on the instruction signal from the controller is not excessively great or small so as to control the delivery oil amount of the variable displacement pump. At the same time, an instruction signal is output to the relief valve and the relief pressure setting means so that the operation power of the actuator is not excessively great or small, thereby controlling the pressure of the pressure oil flowing into the actuator.

According to this conventional hydraulic operation machine, the flow rate and the maximum pressure of the pressure oil flowing into the actuator is automatically limited by the revolution speed setting means, the flow rate adjusting means, the relief pressure setting means and the like. Therefore, it is described in the above patent publication that the operation speed and operation force of the operation machine most suitable for the kind of operation and the operation condition of the selected operation mode can be obtained.

Further, it is described in the above patent publication that since it is possible to also avoid the maximum revolution of the engine which is needless for a certain operation mode, various operations can be smoothly and easily carried out with the same machine and thus, the frequency of misoperation is low, the machine is not brought into a driving state which is harmful for another object or which shortens life of the machine, which leads to a quiet operation, and this is effective for both a skilled operator or a unskilled operator.

In the hydraulic operation machine disclosed in the above patent publication, various suitable operation modes corresponding to various driving and operation conditions are previously assumed, and these modes are stored in the operation mode selecting means. However, these operation modes are selected by an operator by his or her sense or judgement immediately before the operation is started when the kind of operation or operation condition is changed and the operation environment is changed. For example, under a condition in which various variations including variation in weather, a range of operation and a problem whether an obstruction exists or not are caused, correspondence of the set operation mode does not always meet with the actual condition under which the operation is to be carried out.

Further, the controller only uniformly outputs an instruction signal which is consistent with the set operation mode to the engine, the variable displacement pump, the relief valve and the like. If a certain operation mode is once set, even if the kind of executed operation or operation condition is changed, it is not possible to change the set operation speed or the set operation pressure of the operation machine in the operation mode. Therefore, even if the previously set operation mode is not suitable for the actual operation condition, or even if the previously set operation mode is not a mode corresponding to the skill of the operator, the operation in a range of this operation mode is forced to be carried out, and this is prone to lower the operation efficiency.

SUMMARY OF THE INVENTION

The present invention has been accomplished to solve the above conventional problems, and it is a particular object of the invention to provide various work machines in which safety of operation and operation efficiency can be enhanced in accordance with variation in the kind of operation and operation condition when operation is carried out based on a previously set operation mode of an operation machine, and operation speed of the operation machine or running speed of the work machine can finely be adjusted.

According to a first aspect of the invention, there is provided a work machine comprising mode switching means of operation modes of one or more operation machines, wherein the work machine further comprises speed finely-adjusting means capable of finely adjusting an operation speed and/or a running speed to be out of a range of these speeds set in each mode by a manual operation.

According to the invention, if an operator selected one of the operation modes of one or more operation machines by the mode switching means, the actuator of the operation machine or the running motor is automatically controlled by a signal output from the mode switching means. If the operator further operates the speed finely-adjusting means after the operation mode of the operation machine was initialized, the operation speed of the actuator or the driving speed of the running motor in the current operation mode is extended to a value out of the set speed range of the current operation mode by a signal output from the speed finely-adjusting means. A width of extension at that time slightly exceeds a set speed range of the basic operation mode, and the operation of the operation machine can finely be adjusted in a region out from the set speed range of the operation mode by the operation of the speed finely-adjusting means.

Therefore, even under an environment in which operation range is changed or an obstruction may exist, it is possible to effectively obtain optimal operation mode of the operation machine suitable for the kind of operation which is carried out and operation condition and skill of an operator, stable running performance and operability of the operation machine can be realized, and the operation efficiency is remarkably enhanced.

Preferably, a driving circuit for one or more operation machines and a running motor includes flow rate adjusting means, the flow rate adjusting means is operated by a signal output through the speed finely-adjusting means, and a flow rate in the driving circuit is adjusted.

In this invention, when the speeds of the one or more operation machines and the running motor which are automatically controlled based on the operation mode are to be further adjusted, flow rate adjusting means disposed in each of driving circuits of an actuator of the operation machine, the running motor, a revolving motor and the like are selectively operated by a signal output through the speed finely-adjusting means which is operated by the operator, thereby increasing or reducing the flow rate of the pressure oil supplied to the actuator. A certain actuator can smoothly be adjusted without exerting an effect on other actuator.

Further preferably, the flow rate adjusting means includes various main valves, and an opening area of each of various main valves is adjusted by a signal sent through the flow rate adjusting means.

In this invention, the stroke of the spool of the main valve is finely adjusted by the speed finely-adjusting means to increase or reduce the flow rate of the pressure oil supplied to the actuator, and the speeds of the operation machine and the running motor are changed. For example, the operation speed of the operation machine is set based on the operation mode of the operation machine which was initialized, and when it is necessary to further reduce the operation speed, the speed finely-adjusting means is operated to reduce the opening area of the main valve to a value smaller than that when the speed is within the range of the selected operation mode, the flow rate of the pressure oil supplied to the actuator is reduced, and the speed of the operation machine can further be reduced to a value smaller than the lower limit speed of the selected operation mode.

DESCRIPTION OF THE PREFERRED EMBODIMENTS

Preferred embodiments of the present invention will be explained specifically based on the accompanying drawings below.

Figure 1:
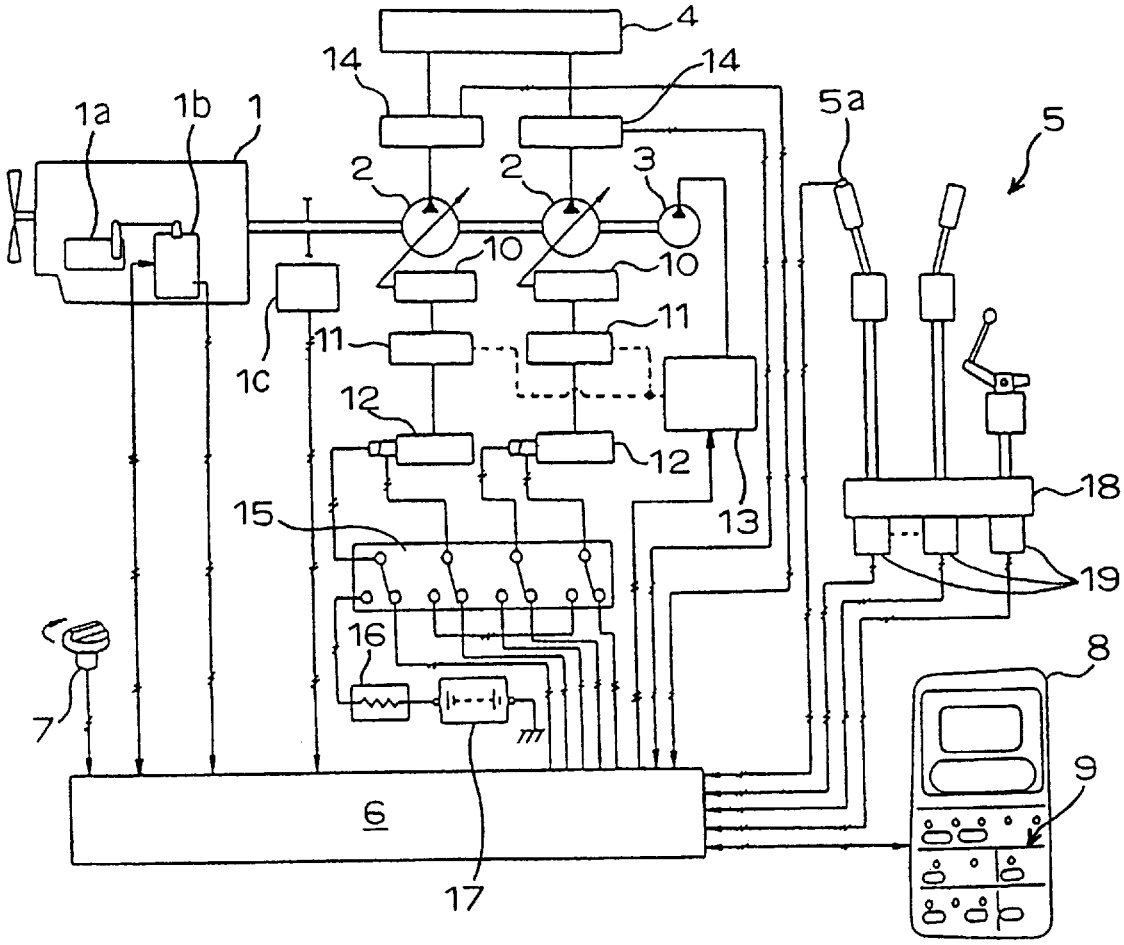
FIG. 1 is a control circuit diagram schematically showing an electric hydraulic system of a hydraulic crane shovel having operation modes which is a representative embodiment of the present invention.
Figure 2:
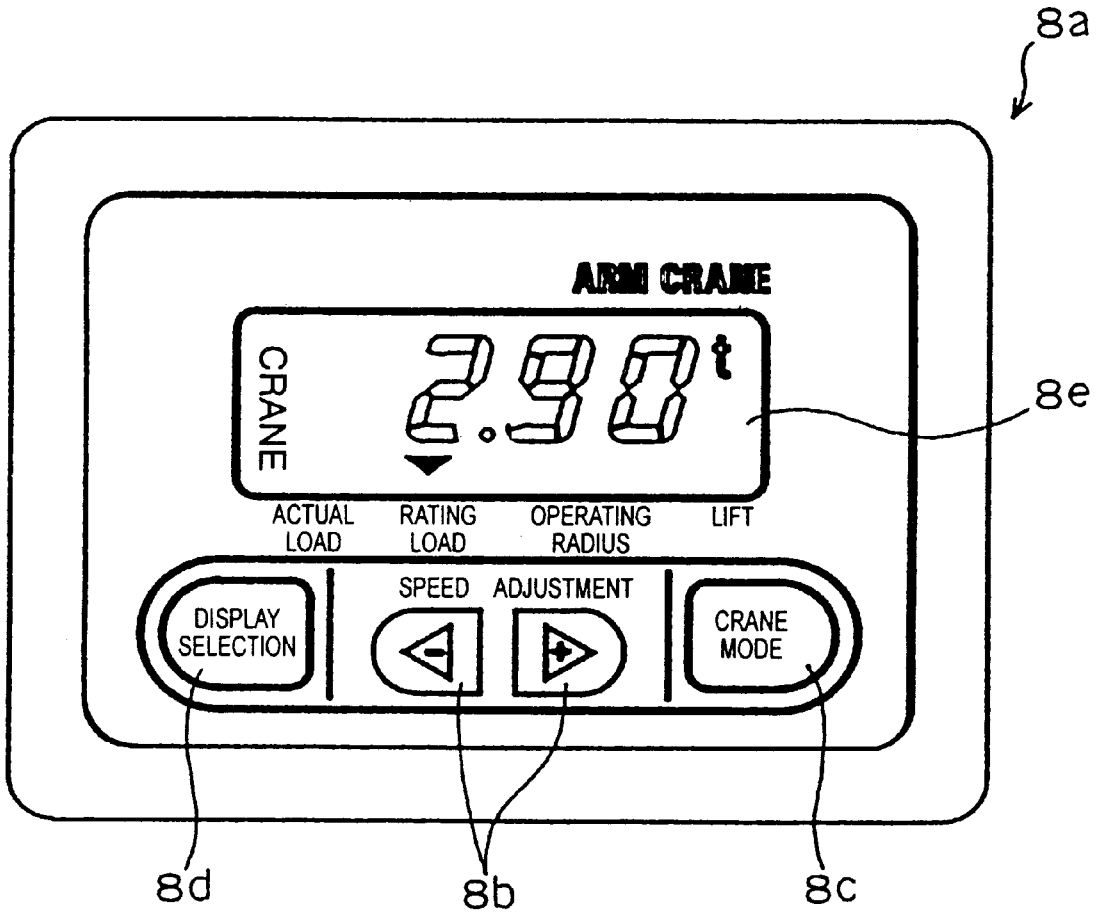
FIG. 2 is a plan view schematically showing one example of a monitor panel for a crane applied to the hydraulic shovel.

FIG. 1 is a control circuit diagram schematically showing an electric hydraulic system of a hydraulic crane shovel having operation modes which is a representative embodiment of the present invention, and FIG. 2 is a plan view schematically showing one example of a monitor panel for a crane applied to the hydraulic shovel. This embodiment will be explained while taking the crane shovel as an example, but the present invention is not limited to this, and the invention can also be applied to various work machines such as bulldozers and tractor shovels.

The crane shovel in this embodiment comprises a running body, a revolving body mounted to the running body such that the revolving body can revolve around a vertical axis, and an operation machine disposed on the revolving body. The operation machine comprises a main boom rising from substantially a central portion of the revolving body, a stick boom pivotally supported on a free end of the main boom for swinging motion in the vertical direction, a bucket supported on a tip end of the stick boom for oscillating motion in the vertical direction, and a hanger hook for an crane operation.

The main boom rises and falls in the vertical direction around a base end of the main boom by means of a pair of main boom cylinders provided between the main boom and the revolving body. The stick boom oscillates in the vertical direction around the tip end of the main boom as a fulcrum. The bucket turns in the vertical direction around a tip end of the stick boom as a fulcrum by a bucket cylinder mounted between the bucket and the stick boom through a pair of left and right biarticulated links. The hanger hook is turnably supported on a stick boom top pin for mounting the bucket to a tip end of the stick boom. When the hanger hook is not used, the hook is accommodated between the left and right links.

As shown in FIG. 1, the hydraulic shovel comprises an engine 1, variable displacement pumps 2, 2 driven by the engine 1, a plurality of operation valves 4 (main valves) for selectively supplying delivered pressure oil from the variable displacement pump 2 to each of the cylinders of the operation machine (not shown), and a plurality of operation levers 5 for independently switching the operation valves 4. In FIG. 1, the operation valves 4 are schematically shown with blocks, and operation levers 5 are illustrated as being one running lever and two operation levers.

Further, there is provided a controller 6 for controlling the revolution number of the engine 1 and a discharge amount of the variable displacement pump 2. The engine 1 and the variable displacement pump 2 are electrically connected to the controller 6. The operation levers 5 disposed in a cab, an engine revolution number dial 7 capable of selecting acceleration or deceleration and a set speed and disposed in the cab, and a monitor panel 8 similarly disposed in the cab are also electrically connected to the controller 6. A reference numeral 5*a* represents a knob switch.

The engine 1 includes a fuel injection pump 1*a* and an electric governor motor 1*b*. A lever of the fuel injection pump 1*a* is oscillated to a high speed revolution position and a low speed revolution position through an operation lever provided on the electric governor motor 1*b* based on an instruction signal output from the controller 6, thereby controlling an amount of fuel to be fed to a fuel injection nozzle of the fuel injection pump 1*a*. A potential signal is always sent to the controller 6, and the engine revolution number is monitored. A reference numeral 1*c* represents an engine revolution number sensor for detecting the engine revolution number to output a revolution sensor signal to the controller 6. The controller 6 compares a detection value of the engine revolution number sensor 1*c* and a preset reference value, and its control signal is output to the electric governor motor 1*b* to adjust the current engine revolution number.

The variable displacement pump 2 is a swash-plate type pump, and comprises a pump body, a servo valve 10, an LS valve 11 (load sensing valve) and a TVC valve 12 (torque variable control valve). A fixed displacement pump 3 is connected to a pilot circuit (not shown) which supplies pilot pressure oil to the operation valves 4, and is also connected to an EPC valve 13 (electromagnetic proportion valve) connected to the controller 6. A reference numeral 14 represents a pressure sensor for detecting discharge pressure of the variable displacement pump 2 to output a pressure sensor signal to the controller 6. The controller 6 compares the detection value of the pressure sensor 14 and a preset reference value, and outputs the control signal to a valve solenoid of the EPC valve 13, thereby adjusting the current pump discharge pressure.

If an LS pressure control signal which is proportional to the engine revolution number is input to the EPC valve 13 from the controller 6, the EPC valve 13 is switched based on the LS pressure control signal from the controller 6, and a 7 discharge pressure of the fixed displacement pump 3 is determined by a switching position of the EPC valve 13. The discharge pressure is introduced into the LS valve 11 through the EPC valve 13. If the output pressure of the LS valve 11 is introduced into the servo valve 10, the servo valve 10 changes angle of the swash plate to control the discharge amount of the variable displacement pump 2.

When the discharge pressure of the variable displacement pump 2 is high, the TVC valve 12 controls the flow rate of the discharge pressure such that the flow rate does not exceed a predetermined value even if a stroke of the operation valve 4 which selectively supplies the delivered pressure oil from the variable displacement pump 2, and controls the horsepower such that the pumping horsepower does not exceeds engine horsepower. One end of a pump redundant circuit switch 15 is connected to a valve solenoid of the TVC valve 12, a battery 17 is connected to the other end through a register 16, and the controller 6 is also connected to the other end. When abnormal condition is generated in the EPC valve 13, electric current is supplied from the battery 17 to the valve solenoid of the TVC valve 12 through the register 16 based on instructions of the controller 6.

The operation valve 4 comprises a flow rate control valve, and is provided in correspondence with a running monitor and the cylinders of the main boom, the stick boom, the bucket and the like. The operation levers 5 are provided in correspondence with the operation valves 4. Each operation lever 5 includes first and second pilot proportional control valves (not shown) for outputting pilot pressure in accordance with the operation amount of the operation lever 5. A shuttle valve 18 is connected to the first and second pilot proportional control valves. The shuttle valve 18 is electrically connected to the controller 6 through an oil pressure switch 19. The shuttle valve 18 selects one of the first and second pilot proportional control valves which has higher pressure, and the higher pressure is detected by the oil pressure switch 19, and its detection signal is output to the controller 6.

Disposed on the monitor panel 8 are various display selecting switches, a liquid crystal display, a plurality of mode switching switches 9 capable of arbitrarily selecting operation modes of the operation machine, a running speed mode of the work machine and the like, and various switches. The mode switching switches 9 are electrically connected to the controller 6. The controller 6 previously stores a relation of ON-OFF combination of the mode switching switches 9 and the like. The controller 6 calculates the ON-OFF combination of the mode switching switch 9, and constitutes mode switching means which outputs a mode switching signal.

FIG. 2 shows a crane monitor 8*a* disposed on the monitor panel 8. This monitor 8*a* comprises a speed finely-adjusting switch 8*b* forming a portion of a characteristic part of the present invention, a crane mode switch 8*c*, a display selection switch 8*d* for calling up data such as an actual load, a rating radius and the like, and a liquid crystal display 8*e* for showing the data. Detection data and the like of a main boom/stick boom angle sensor and a main boom cylinder pressure sensor disposed for carrying out the crane operation safely are input to the controller 6, and its calculation result is shown on the liquid crystal display 8*e* by appropriately operating the display selection switch 8*d*. The controller 6 is electrically connected to a warning display device (not shown) such as a buzzer or a lamp.

If the operator selectively operates the mode switching switch 8*a* in accordance with the kind of operation or condition of the operation to be carried out, these signals are output to the controller 6. The controller 6 calculates the pump discharge amount or the engine revolution number based on the output signal of the mode switching switch 8*a* in accordance with a determined method, and outputs the control signal to the electric governor motor 1*b* or the EPC valve 13.

This mode switching means automatically adjusts operation speed and the like of the operation machine in various operation modes for driving the cylinder of the operation machine, the running monitor and the like at low speed, medium speed or high speed, in addition to the operation force and operation speed of the operation machine and the running speed of the work machine required during normal operation including general various civil engineering operation and crane operation such as digging, loading, correcting of earth and sand.

The hydraulic crane shovel in this embodiment having the above structure is provided with speed finely-adjusting means which is a characteristic part of this invention capable of finely adjusting the speed to a value out of the speed range set in each mode by the manual operation. The most characteristic feature of the present invention is that if the operator operates the speed finely-adjusting means after each mode was initialized, the engine revolution number and the pump discharge amount are increased or reduced, or any one of the engine revolution number or the pump discharge amount is increased or reduced based on the signal output from the speed finely-adjusting means. According to the present invention, the operation speed of the cylinder of the operation machine and the driving speed of the running motor in the current operation mode are extended beyond the set speed range of the current operation mode.

Figure 3:
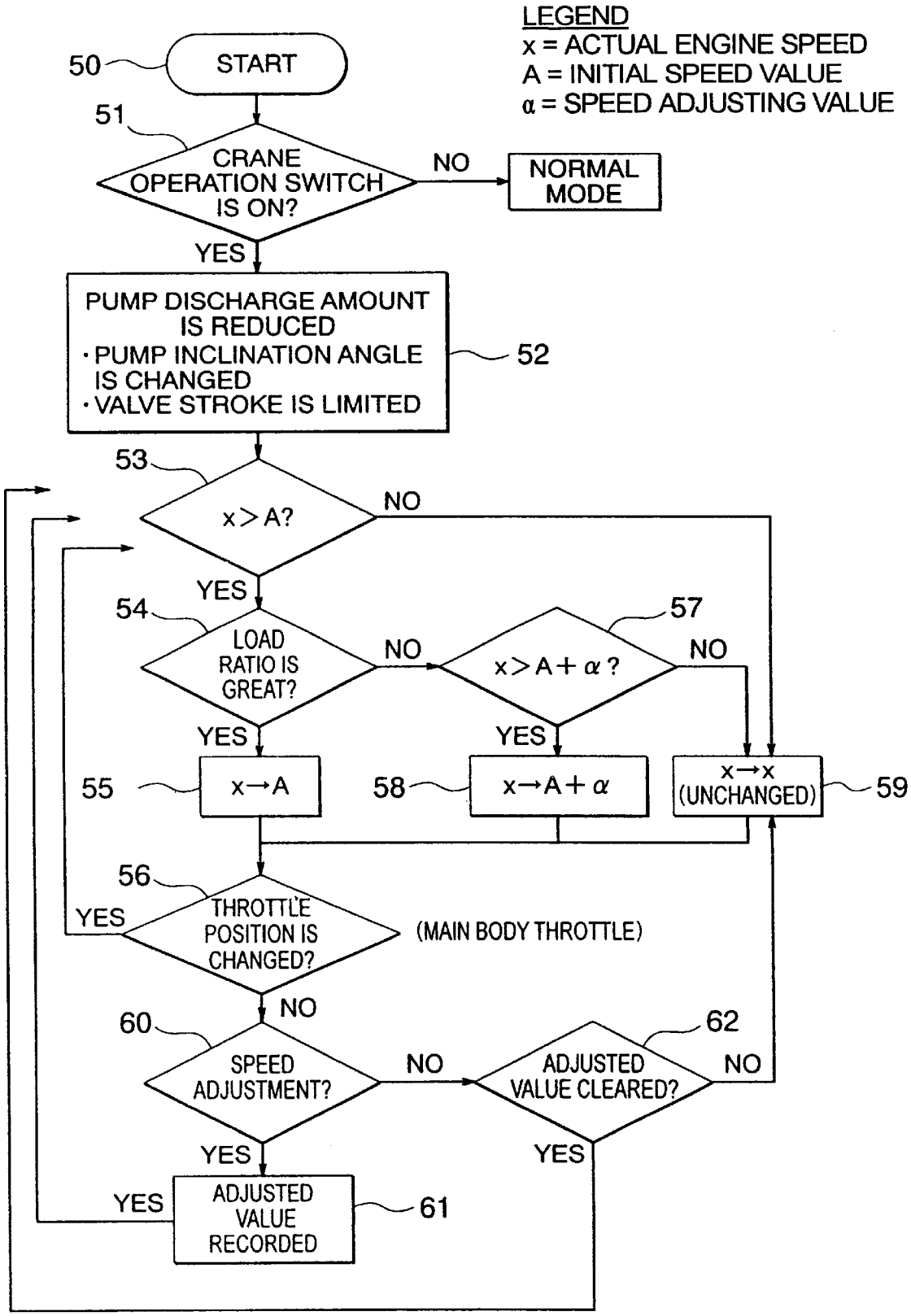
FIG. 3 is a flowchart showing one example of processing procedure of speed finely-adjusting means applied to the hydraulic shovel.

The speed finely-adjusting means which is a representative embodiment of the present invention will be explained with reference to FIG. 3. FIG. 3 shows a processing procedure of the speed finely-adjusting means applied to the hydraulic crane shovel which is the present embodiment. A symbol A in FIG. 3 represents an initialized value of the engine revolution for the operation mode, a symbol a represents an engine revolution adjusting value, and a symbol X represents a current engine revolution actually-measured value. The present embodiment will be explained while taking the processing procedure in a crane operation mode as an example, but the present invention is not limited to this, and the invention can also be applied to various operation modes of the operation machine.

In FIG. 3, the procedure is started at a block 50. First, in block 51, an input state of the crane mode switch 8*c* is confirmed by the controller 6. If the crane mode switch 8*c* is confirmed to be ON, the procedure proceeds to block 52. In block 52, the inclination angle of the pump is reduced based on the engine revolution initialized value A for a standard crane mode which was set by the output signal of the crane mode switch 8*c*, thereby reducing the pump discharge amount, and at the same time, the opening area of the valve stroke of the operation valve 4 is limited to a small value, and control is carried out in accordance with the pump discharge amount.

Next, in block 53, the current engine revolution number is read, and it is judged whether the engine revolution actually-measured value X is greater than the crane engine revolution initialized value $\alpha$. If it is judged that the current engine revolution number is greater, the procedure proceeds to block 54. In block 54, it is judged whether a load ratio (engine load ratio, hereinafter) of a hanging value load to a hanging rating load is great.

If it is judged that the engine load ratio is great, the procedure proceeds to blocks 55 and 56. First, in block 55, the current engine revolution is set to the same value as the speed of the engine revolution initialized value A. Next, in block 56, a control signal is output to the electric governor motor 1*b* to adjust the current engine revolution speed to a value which coincides the engine revolution initialized value A, and the procedure returns to the block 53 again.

If it is judged that the engine load ratio is small in block 54, the procedure proceeds to block 57. In block 57, it is judged whether the current engine revolution should be increased or not. If it is judged that the current engine revolution should be increased, the procedure proceeds to block 58. In block 58, engine revolution speed corresponding to the sum of the engine revolution initialized value A and the engine revolution adjusting value $\alpha$ is obtained, and the procedure proceeds to block 56. In block 56, a determination is made to output a control signal to the electric governor motor 1*b*.

In block 57, if it is judged that the current engine revolution speed should not be increased, the procedure proceeds to block 59. In block 59, the current engine revolution speed is maintained, and the procedure proceeds to block 56. In block 56, it is instructed not to output the control signal to the electric governor motor 1*b*.

If it is judged in block 53 that the current engine revolution speed is smaller than the engine revolution initialized value A, the procedure proceeds to block 59. In block 59, the current engine revolution speed is maintained, and the procedure proceeds to block 56. In block 56, it is instructed not to output the control signal to the electric governor motor 1*b*.

The operation speed at the time of the standard crane operation is controlled in accordance with the above-described processing procedure using the mode switching means. When the crane operation is carried out based on the preset crane mode, it is possible to further increase or reduce the initially set speed in the crane mode by operating the speed finely-adjusting switch 8*b* shown in FIG. 2 to actuate the speed finely-adjusting means which is the characteristic part of the present invention capable of finely adjusting the speed to a value out of the range.

If the operator selectively operates the speed finely-adjusting switch 8*b*, the procedure proceeds to block 60. In block 60, the input state of the speed finely-adjusting switch 8*b* is confirmed by the controller 6. If it is confirmed that the speed finely-adjusting switch 8*b* is in the ON state, the procedure proceeds to block 61. In block 61, the engine revolution finely adjusted value for the crane mode set based on the output signal of the speed finely-adjusting switch 8*b* is recorded. The pump discharge amount and the engine revolution number based on the finely adjusted value are calculated, these signals are output to the electric governor motor 1*b* and the EPC valve 13. In this manner, the crane operation in the crane mode set based on the speed finely-adjusting means is carried out.

If it is confirmed in block 60 that the speed finely-adjusting switch 8*b* is in the OFF state or the initial ON state of the speed finely-adjusting switch 8*b* is maintained, the procedure proceeds to block 62. In block 62, it is judged whether the set of the engine revolution finely adjusted value recorded in the controller 6 is cleared. If the set of the finely adjusted value is not cleared, the crane operation in the crane mode set based on the speed finely-adjusting means is continued. If it is judged in block 62 that the finely adjusted value is cleared, the procedure returns to block 53. The operation similar to the foregoing processing procedure is sequentially repeated, and the crane operation in the standard crane mode is carried out.

Figure 4:
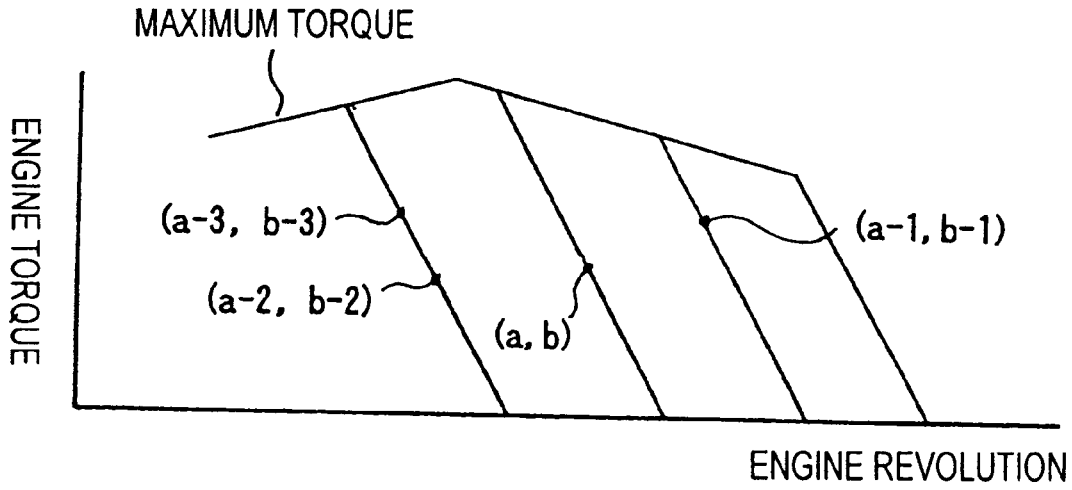
FIG. 4 is a characteristic diagram showing a relation between engine torque and engine revolution number of the hydraulic shovel.

FIG. 4 shows a relation between an engine torque and the engine revolution number. In FIG. 4, a symbol a represents the standard engine revolution initialized value by operation of the crane mode switch 8*c* initialized in the crane mode. A symbol b represents a standard discharge amount initialized value of the pump. Symbols a-1 and b-1 represent adjusting values of the engine revolution and the pump discharge amount at the time of acceleration by the operation of the speed finely-adjusting switch 8*b*. Symbols a-2 and b-2 represent adjusting values of the engine revolution and the pump discharge amount at the time of deceleration.

If the speed finely-adjusting switch 8*b* is operated to a high speed side, the initialized values a and b of the engine revolution number and the pump discharge amount which are initialized in the crane mode are finely adjusted to the adjusted values a-1 and b-1 which are out of range. The speeds corresponding to the initialized values a and b are increased to speeds corresponding to the adjusted values a-1 and b-1 of the engine revolution number and the pump discharge amount which are out of range. On the other hand, if the speed finely-adjusting switch 8*b* is operated to a low speed side, the speeds corresponding to the initialized values a and b are reduced to speeds corresponding to the adjusted values a-2 and b-2 which are out of range. In this manner, the operation speed of the crane mode and the driving speed of the running motor are finely adjusted in a region out of set speed range of the current crane mode.

At that time, the engine revolution number dial 7 capable of selecting the acceleration, deceleration and the set speed is turned to the low speed side, and the control signal is output to the electric governor motor 1*b*. The electric governor motor 1*b* is maintained in the low speed side to reduce the engine revolution. With this, the adjusted values a-1 and b-1 of the current engine revolution number and the pump discharge amount are further adjusted to adjusted values a-3 and b-3 of the engine revolution number and the pump discharge amount.

According to the present embodiment, the controller 6 calculates the actual load based on respective output signals of a pressure sensor for detecting the hydraulic pressure on the side of the bottom of the main boom, a main boom angle sensor, a stick boom angle sensor and a crane mode switch, compares the calculated value and the preset rating load value, and monitors the load state by the hanging load. At the time of crane operation, when the speed finely-adjusting switch 8*b* is operated toward the high speed side by the operator and the speeds are increased to the adjusted values a-1 and b-1 which are out of range of the initialized values a and b of the engine revolution number and the pump discharge amount, if it is judged that the hanging load is in an excessive state, the engine revolution number and the pump discharge amount are reduced into the range of the initialized values a and b of the engine revolution number and the pump discharge amount, and the warning display device is operated. By employing the above structure, safety of the operation at the time of crane operation is further enhanced.

Figure 5:
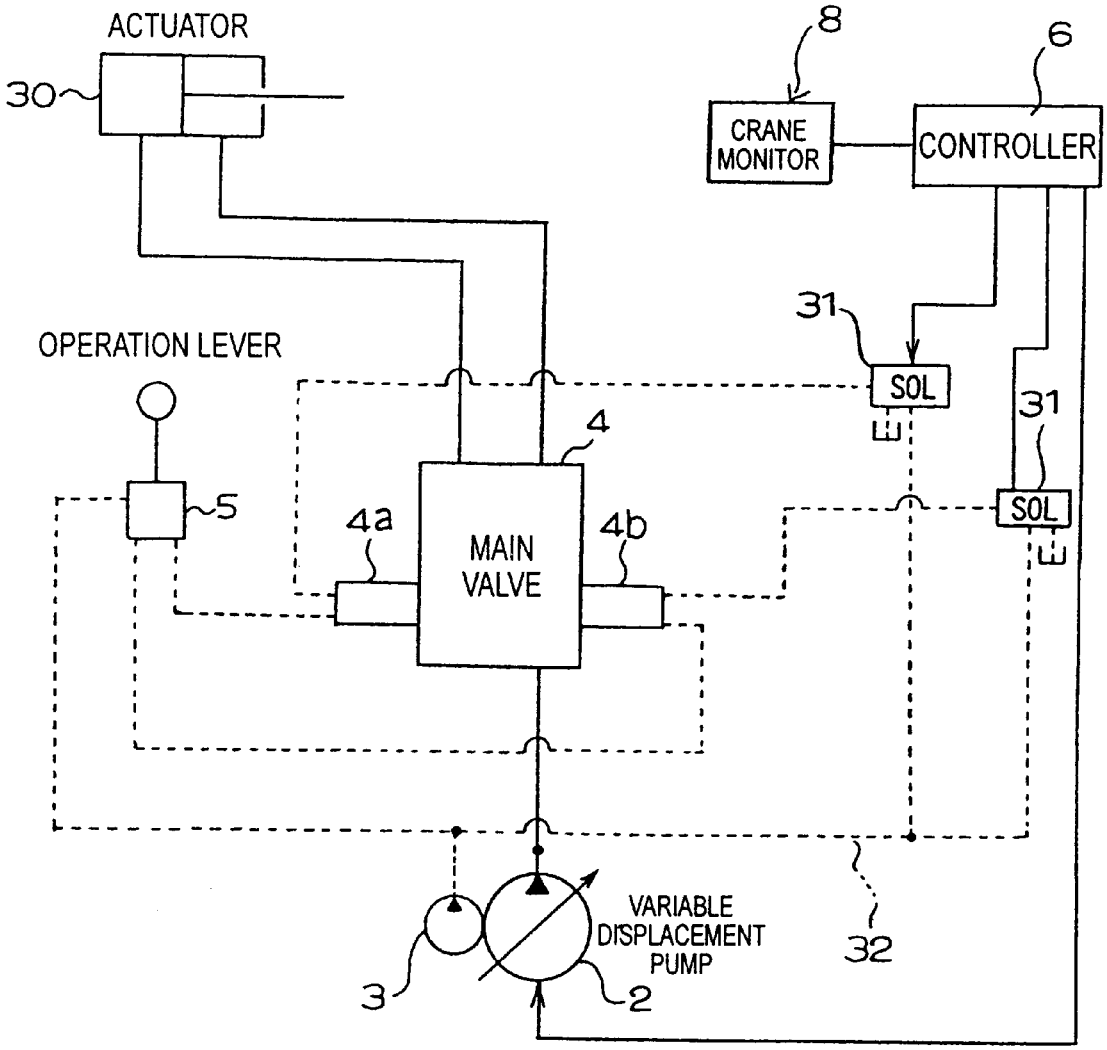
FIG. 5 is a hydraulic circuit diagram showing another embodiment of the speed finely-adjusting means applied to the hydraulic shovel.

FIG. 5 shows another embodiment of the speed finely-adjusting means of the present invention. In FIG. 5, the single operation lever 5 for independently switching the operation valve 4 which supplies delivered pressure oil from the variable displacement pump 2 to the cylinder 30 of the operation machine is connected to first and second pressure-receiving portions 4*a* and 4*b* of the operation valve 4 via the fixed displacement pump 3 connected to the variable displacement pump 2. If the operation lever 5 is operated, the pilot pressure oil supplied from the fixed displacement pump 3 is applied to either one of the pressure-receiving portions 4*a* and 4*b*. The operation valve 4 is switched from a non-operating position to a predetermined operating position, and the cylinder 30 is driven by the operation valve 4.

In a driving circuit of this operation machine, a pair of solenoid valves 31, 31 are respectively connected to the first and second pressure-receiving portions 4*a* and 4*b*, and are also respectively connected to the operation lever 5 through a pilot circuit 32 connected to the fixed displacement pump 3. Further, the solenoid valves 31, 31 are electrically connected to the controller 6 which connects the speed finely-adjusting switch of the monitor panel 8, respectively. The variable displacement pump 2 is electrically connected to the controller 6. The solenoid valves 31, 31 connect the pilot circuit 32 and the first and second pressure-receiving portions 4*a* and 4*b* by a signal output from the controller 6 based on the ON operation of the speed finely-adjusting switch.

When the operation machine is in a set speed range of the selected operation mode, the speed finely-adjusting means in this embodiment finely adjusts the stroke of the spool of the operation valve 4 by a pilot pressure oil from the fixed displacement pump 3 through the solenoid valves 31, 31, thereby increasing or reducing the flow rate of the pressure oil supplied to the cylinder 30, and adjusting the operation speed of the operation machine.

When the operation speed of the operation machine is set based on the operation mode of the operation machine which is initialized, if it is necessary to lower the operation speed, the operator operates the speed finely-adjusting switch and then, the necessary solenoid valve 31 is operated by a signal output from the controller 6. A pilot pressure oil from the fixed displacement pump 3 is supplied to either one of the first and second pressure-receiving portions 4*a* and 4*b* of the operation valve 4 through the pilot circuit 32. An opening area of the operation valve 4 is reduced as compared with that when the speed is within the speed range of the selected operation mode, the flow rate of the pressure oil from the variable displacement pump 2 supplied to the cylinder 30 is reduced, and the speed of the operation machine is further reduced to a lower value than a lower limit speed of the selected operation mode.

The operation valve 4 is automatically operated, the flow rate adjusting means for adjusting the opening area of the operation valve 4 is not limited to the above embodiment, and various valves can be applied. In this case, an output side circuit of the operation valve 4 may be provided with an electromagnetic throttling valve, the electromagnetic throttling valve may be switched by a signal output form the controller 6 to selectively reduce the flow rate of the pressure oil flowing into the cylinder 30.

In the flow rate adjusting means, various flow rate adjusting valves may be disposed in each driving circuit of one or more operation machine and running motor which are automatically controlled based on the operation mode, the flow rate adjusting valves may be selectively operated, thereby increasing or reducing the flow rate of the pressure oil supplied to the cylinder or the actuator of the running motor.

As apparent from the above explanation, according to the work machine of the present embodiment, by employing the speed finely-adjusting means constituted in the above-described manner, an optimal crane mode suitable for an operation speed of the crane mode, a driving speed of the running motor or skill of the operator can effectively be obtained even under an environment in which operation range is changed or an obstruction may exist. Further, more stable running performance of the work machine and more safe operability of the crane can be realized, safety of the crane operation can sufficiently be secured, and the operation efficiency is extremely enhanced. The present invention is not limited to the above embodiments, and the invention of course covers a technical range which can easily be changed by a person skilled in the art from these embodiments.

What is claimed is:

1. A work machine having an engine, a variable displacement pump, a work implement driven by the engine or the variable displacement pump, and a controller, the controller automatically controlling an engine speed and a discharge of the variable displacement pump according to an operation mode of the work machine, said work machine comprising:

a manually actuated operation mode switch configured and arranged to allow an operator to manually select the operation mode, the controller automatically setting an operating speed of the work implement and/or the engine speed based on the selected operation mode; and a manually actuated speed fine-adjustor having an adjusting signal output to said controller, wherein the controller adjusts the set operating speed of the working implement and/or the engine speed, based on the adjusting signal output.

2. A work machine according to claim 1, further comprising a driving circuit for the work implement having a flow rate adjustor, the flow rate adjustor being operated by a signal output through the speed fine-adjustor, wherein a flow rate in the driving circuit is adjusted.

3. A work machine according to claim 2, wherein the driving circuit further comprises main valves, each main valve having an opening area adjusted by the flow rate adjuster.

* * * * *